US006612968B1

(12) United States Patent
Alvaro

(10) Patent No.: US 6,612,968 B1
(45) Date of Patent: Sep. 2, 2003

(54) EQUIPMENT FOR PRACTICING SPORT FENCING

(75) Inventor: Nicolino Alvaro, Turin (IT)

(73) Assignee: Nasycon s.a.a. di Alvaro Nicolino & C., Turin (IT)

( * ) Notice: Subject to any disclaimer, the term of this patent is extended or adjusted under 35 U.S.C. 154(b) by 0 days.

(21) Appl. No.: 09/552,570

(22) Filed: Apr. 19, 2000

(30) Foreign Application Priority Data

Apr. 19, 1999 (IT) ..... TO99A0309

(51) Int. Cl.[7] ..... A63B 69/02

(52) U.S. Cl. ..... 482/12; 482/1; 463/47.1; 273/455

(58) Field of Search ..... 482/1, 2, 12; 463/47.1; 273/455; 200/61.42

(56) References Cited

U.S. PATENT DOCUMENTS 2,294,026 A 8/1942 De Tuscan
2,916,287 A 12/1959 Davey

FOREIGN PATENT DOCUMENTS

| | | | |
|---|---|---|---|
| EP | 0158567 | 10/1985 | |
| EP | 0736744 | 10/1996 | |
| FR | 1132671 | * 3/1957 | ..... A63B/69/02 |
| FR | 2532412 | 3/1984 | |

* cited by examiner

*Primary Examiner*—Nicholas D. Lucchesi
*Assistant Examiner*—Tom Nguyen
(74) *Attorney, Agent, or Firm*—Sughrue Mion, PLLC

(57) ABSTRACT

Equipment for practicing sport fencing in all its forms and without wires, including a weapon and a protective mask. The weapon comprises a blade with a grip, both formed as a single piece of molded plastic with a longitudinal through hole via which a touch-detection unit housed in a seat in the tip of the blade and a touch-signalling unit housed in a receptacle in the grip are connected together.

11 Claims, 4 Drawing Sheets

V
V

EQUIPMENT FOR PRACTICING SPORT FENCING

BACKGROUND OF THE INVENTION

The subject of the present invention is fencing equipment, including a weapon and a protective mask.

Traditionally, the weapons used to practise sport fencing (épée, sabre, foil) comprise an electrical system connected to the tip of the blade which signals a touch on a suitable machine via an external electrical wire which is connected to a suitable piste on which the fencing bouts take place.

In order to encourage young people to take up fencing, simplified forms of the weapons have already been proposed—for example toy foils in which the blade is made partly or wholly from plastic. These toy weapons have, however, proved unsatisfactory for various reasons: on account of their structure, because they cannot be relied upon always to signal a touch in an effective manner and because, in the final analysis, they fail fully to simulate any of the three weapons used in sport fencing—i.e. the foil, épée or sabre.

SUMMARY OF THE INVENTION

The primary object of the present invention is to overcome the abovementioned drawbacks.

A specific object of the invention is to produce a weapon for practising sport fencing which has a simple, but nevertheless robust and functional, structure.

A further specific object of the invention is to produce a weapon for practising sport fencing which reproduces automatic registering of a touch in a simple, cost-effective and safe way, without the need for external wires connected to special scoring machines.

Another specific object of the invention is to produce a weapon for practising fencing in all its forms, in other words one that can simulate all three weapons—the foil, épée and sabre—equally well and to virtually their full individual scope, in order to provide more effective teaching of the sport using a practical, safe, effective and inexpensive instrument.

Another object of the present invention is to provide equipment for practising sport fencing in all its forms and without wires, including—in addition to the weapon—a protective mask that is more comfortable, practical and effective, not only when compared with conventional masks which are made from steel mesh but also the plastic ones available today, and at the same time safe and shaped such as to ensure optimum vision.

According to the invention these objects are achieved by means of a weapon, the basic characteristics of which are defined in claims 1–15, by means of a protective mask as defined in claims 16 and 17, and by means of equipment for practising sport fencing in all its forms and without wires, as defined in claim 18.

BRIEF DESCRIPTION OF THE DRAWINGS

The invention will now be described in detail with reference to the appended drawings which are provided solely by way of non-limiting example, in which.

DETAILED DESCRIPTION OF THE INVENTION

Figures 1, 2, 3, 4, 5:
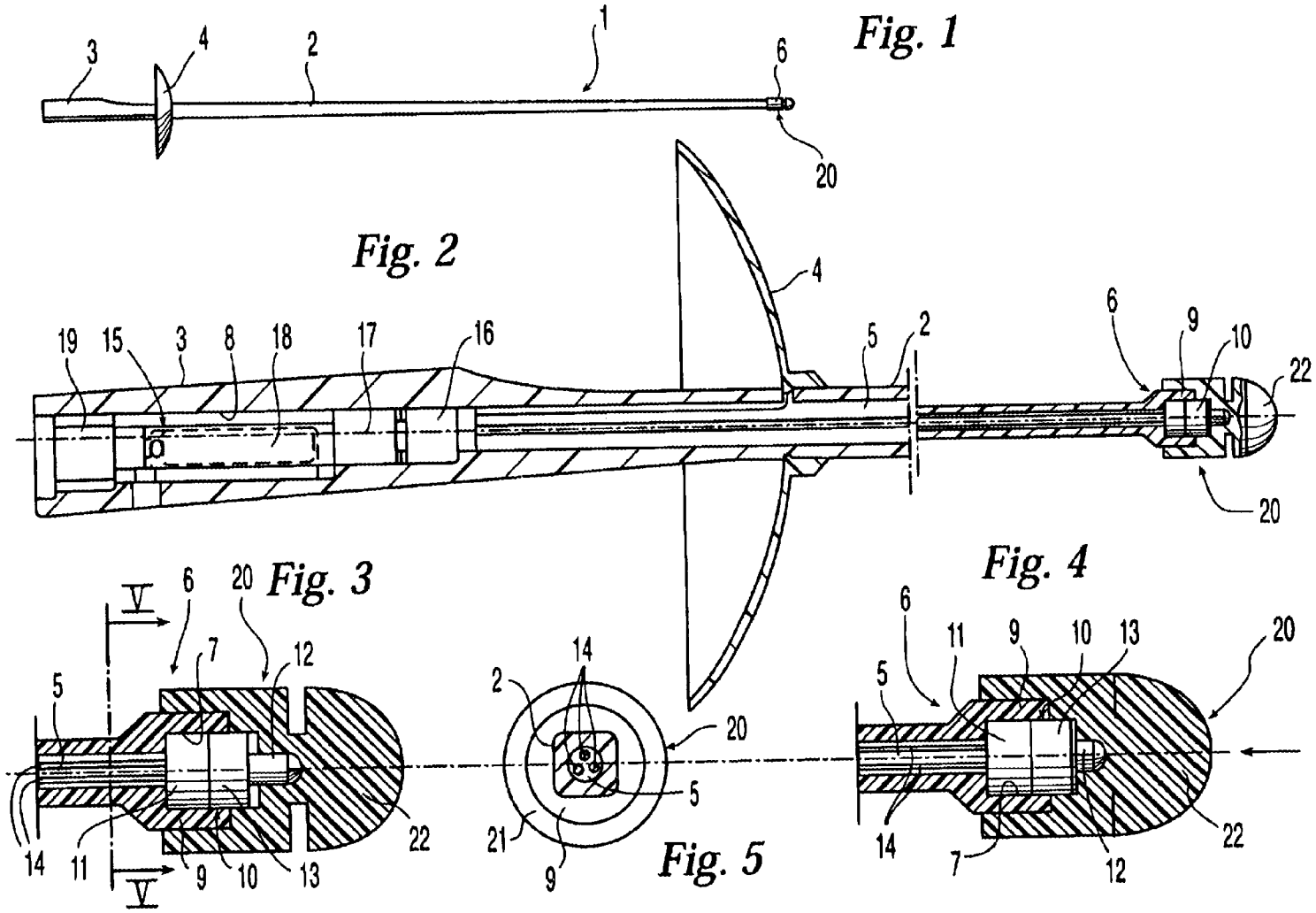
FIG. 1 is a diagrammatic side view of a weapon according to the invention for practising sport fencing.
FIG. 2 is a partial view on a larger scale, in longitudinal cross section, of FIG. 1.
FIG. 3 shows, on a larger scale, the tip of the blade of the weapon and in a first condition.
FIG. 4 is a view similar to FIG. 3 in a second condition.
FIG. 5 is a view in cross section on the plane V—V in FIG. 3.
Figure 9:
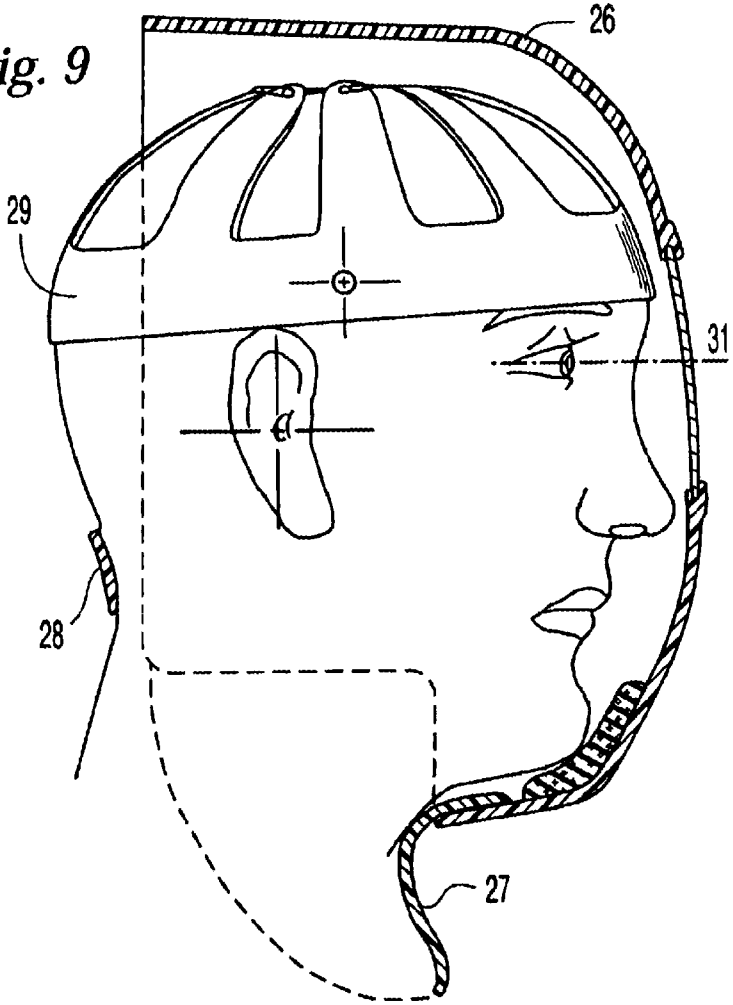
FIG. 9 is a view in vertical section through the mask while being worn.
Figure 6:
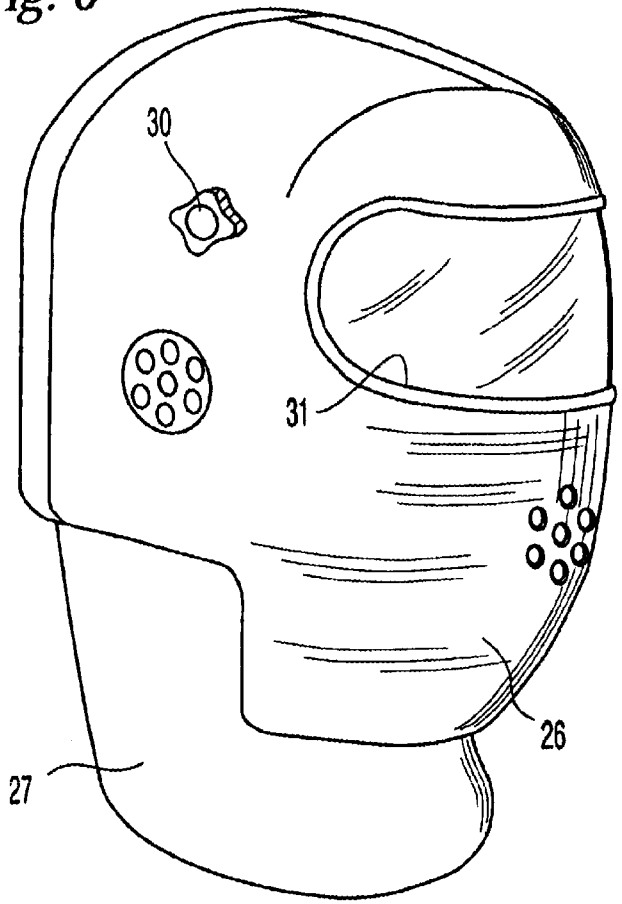
FIG. 6 is a simplified perspective view of a protective mask that can be used in conjunction with the weapon of FIGS. 1 to 5.
Figure 8:
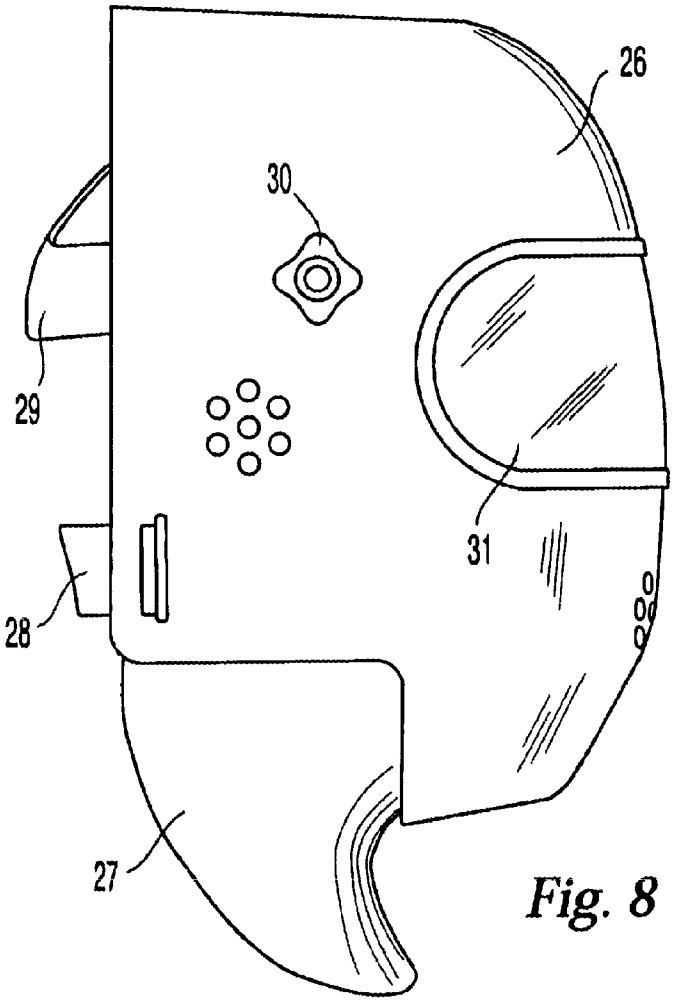
FIG. 8 is a side view of FIG. 6.
Figure 7:
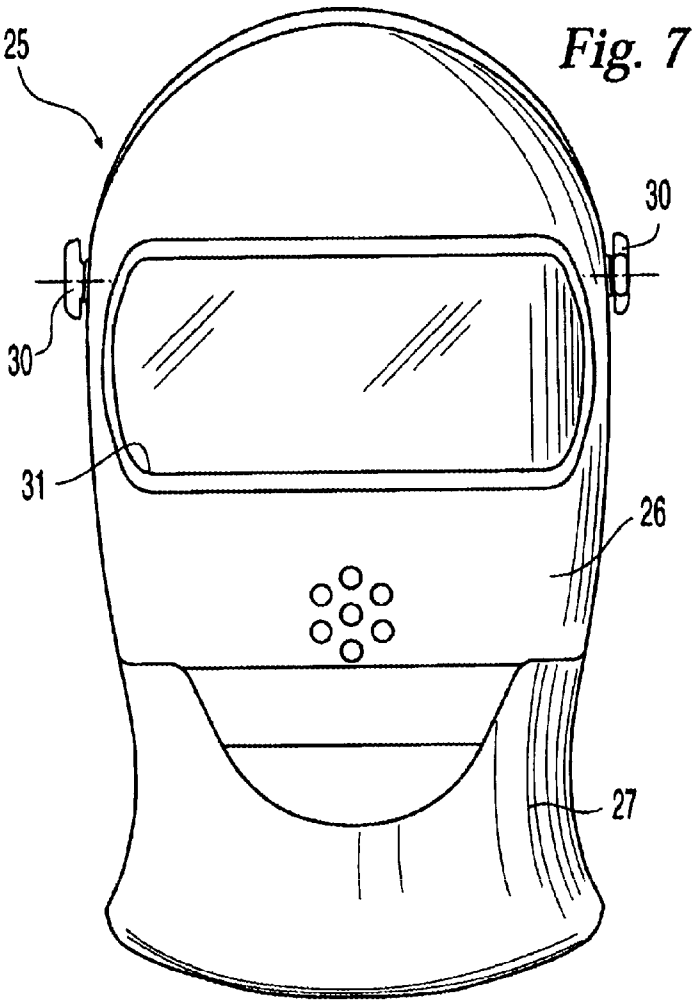
FIG. 7 is a front view of FIG. 6.

Referring initially to FIGS. 1 to 5, the numeral 1 denotes, as a whole, a weapon for practising sport fencing in all its forms and without wires, according to the invention.

The weapon 1 essentially comprises a blade 2, a handle or grip 3 and a guard 4 which protects the grip 3.

The blade 2 and the grip 3 are made as a single piece of moulded plastic, for example from nylon or an acetal resin and similar materials, through which a longitudinal through hole 5 is formed, extending continuously from the tip of the blade 2, given the general reference 6, to the pommel end of the grip 3.

The cross section of the blade 1 can, for example, be completely circular or completely rectangular (as is the case in the example illustrated), or it can be partly rectangular and partly circular. In all cases, its cross section tapers gradually down from the guard 4 towards the tip 6, as does the through hole 5 which usually has a conically shaped circular section.

The grip 3 can be a French grip, but able to be used by both right-handed and left-handed fencers, or it can be anatomically shaped. The length of the blade 2 and the grip 3, as well as the overall weight of the weapon 1 will normally be the same as those of conventional weapons (foil, épée, sabre).

The flexibility of the blade 2 can be adjusted by varying the formulation of the plastic from which it is made.

The longitudinal hole 5 communicates on the one hand with a seat 7 formed in the tip 6 of the blade 2 and on the other hand with a receptacle 8 formed inside the grip 3.

The seat 7 is formed within an enlarged portion 9 of the tip 6 and houses a touch-detection unit—given the general reference 10—including, if appropriate, a push-button 12 type switch 11 (which however may not be necessary) and a special sensor 13. This sensor 13 can be of the magnetoresistive type, a Hall sensor, a magnetic sensor, a capacitive proximity sensor, a photoelectric sensor, a pressure sensor or, alternatively, a combination of these, the function of this sensor being discussed in greater detail below.

The switch 11 and the sensor 13 are electrically connected, via conductors 14 which run through the longitudinal hole 5, to a touch-signalling unit which is denoted 15 overall and is housed inside the receptacle 8 of the grip 3. The signalling unit 15 expediently includes an electronic device 16 which processes the signals coming from the touch-detection unit 10 and a unit 17 which produces an acoustic signal, both of which are powered by means of one or more rechargeable batteries 18 which are also contained inside the grip 3.

The processing device 16 can also expediently be connected to a remote transmitter 19 for transmitting coded signals, for example radio waves, which device is interfaced with an existing apparatus for producing acoustic and/or luminous signals used in sport fencing. As will become clear, this apparatus for producing acoustic and/or luminous signals can also be advantageously attached directly on a protective mask to be used in conjunction with the weapon 1 for practising fencing.

Furthermore, the signalling unit 15 can also include an actuating unit—which is not illustrated but is of conventional type—for activating a luminous warning indicator which is functionally connected, for example, to the guard 4, or to the blade 2 (over part or all of the latter), or to other areas of the weapon 1. This luminous warning indicator may, for example, incorporate fibre optics.

According to another aspect of the invention, the enlarged portion 9 on the tip 6 of the blade 2 carries a protective button which has been given the general reference 20. This button 20 includes a beaker-shaped body 21 which is mounted by means of pressure on the enlarged portion 9 and into which the push-button 12 of the switch 11 extends. The end of the beaker-shaped body 21 is attached to a ferrule generally having a hemispherical shape 22 which can move elastically in an axial direction relative to the beaker-shaped body 21, between an inactive extended position, shown in FIG. 3, and a depressed position, shown in FIG. 4, in which it activates the push-button 12 of the switch 11 by means of pressure. The body 21 and the ferrule 22 are advantageously made as a single piece of suitable elastic material, for example from thermoplastic rubber, and the extended position shown in FIG. 3 corresponds to an undeformed condition while the depressed position shown in FIG. 4 corresponds to an elastically compressed position caused by the touch.

In this embodiment the ferrule 22 limits the travel of and the stresses on the push-button 12 of the switch 11, when present.

The guard 4, which is fixed on the grip 3 using any conventional system and in a manner such that it can be rapidly disengaged and replaced, can be made from various materials: plastic, magnetized plastic, plastoferrite, metal, etc., depending on criteria that will be discussed below.

Using the same basic structure made up of the blade 2 and the grip 3 housing the functional components described above, the weapon 1 can be configured from an operational point of view so that it selectively simulates the three weapons used in fencing, i.e. the foil, sabre and épée. The components that can be configured to achieve this consist of the sensor 13 and the guard 4.

More specifically, using a magnetized guard 4 and a sensor 13 consisting of a magnetic or Hall sensor, the weapon 1 can be used to simulate the épée. As is known, in the case of the épée, the whole of the opponent's body is a valid target area—except of course for a hit on the guard 4; using a magnetized guard 4 it is possible to obtain a signal to neutralize the opponent's hit on the said guard and on the piste (which is metallic), thereby simulating épée fencing without the need for any connections to external devices.

In the case of the foil, as is known, the valid target area consists of a limited part of the opponent's body, defined by a suitable metallic vest. In this case, by configuring the weapon in the same way as the épée—i.e. with a suitably magnetized guard—and with the opponent wearing a metallized vest (like the ones currently in use), it is possible to simulate foil fencing perfectly, again without the need for wires connected to external devices.

Lastly, in the case of the sabre the target area, as is known, consists of a limited part of the opponent's body defined by a suitable metallic jacket with sleeves. In this case, too, by using a suitably magnetized guard and with the opponent wearing a metallized jacket (like the ones currently in use), it is possible to simulate sabre fencing to some degree, again, without the need for connections to external devices.

It should be clear from the foregoing that the weapon 1 according to the invention, in addition to enabling all three types of weapon to be simulated equally well and to their full individual scope without the need for connections to external apparatus, can also be produced—by virtue of the hollow configuration of the blade 2—with a reduced weight, thereby encouraging its use by young fencers. Moreover, the weapon 1 can be manufactured at a very much lower cost by using, for example, a mould made from hardened and tempered steel having a cavity with a metal core of specific shape (conical) supported by small centring pins in order to form the through hole, a special tool for extracting the core using a motorized linear actuator also being provided. Contrary to the standard processing methods, this production system also makes it possible to produce a blade 2 of extremely regular cross section.

Alternatively, the through hole in the blade could also be produced using nitrogen blow-moulding technology.

According to a variant, both the acoustic signal and the luminous signal generated by the respective warning indicators of the signalling unit 15 could expediently be timed, so that the duration of the signal indicating a touch is independent of the pressure exerted by the fencer when scoring the said touch.

Moreover, both the acoustic signal and the luminous signal could have various characteristics in terms of their tone and brightness, respectively, so as to make the judges' task easier with respect to awarding hits. A device for varying the tone and/or brightness could also be inserted in the said weapon.

Figure 12:
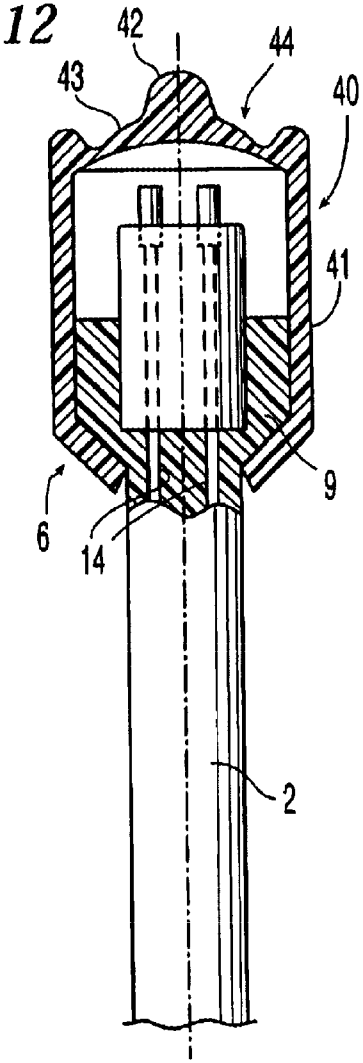
FIG. 12 shows a variant of FIG. 3.

FIG. 12 shows a variant of the protective button attached to the enlarged portion 9 of the tip 6 of the blade 2. This protective button, denoted overall by the reference 40, includes a beaker-shaped body 41 which is mounted by means of pressure on the enlarged portion 9 and the end 44 of which has a ferrule-like projection 42 which is joined to the side wall of the body 41 via a thinned annular part 43. The ferrule-like projection 42 is thus able to move elastically in an axial direction relative to the beaker-shaped body 41, between an inactive extended position, shown in FIG. 12, and a depressed position in which it directly activates the signalling unit 15. The body 41 and the ferrule 42 are in this case advantageously made as a single piece of electrically conductive thermoplastic rubber, which means that the switch 11 can be dispensed with, thereby reducing the production costs of the weapon 1 and at the same time increasing its reliability. When the ferrule-like projection 42 is in the depressed condition, the end 44 of the beaker-shaped body 41 acts directly, in the manner of a conducting bridge, on the terminals of the conductors 14 so as to actuate the signalling unit 15.

It should be noted that the whole touch-detection and touch-signalling system which functions without wires is fully compatible with conventional systems which do use wires and which are in use today. Thus, this system can be used with wires by simply replacing the signalling unit 15 with a suitable pin, thereby offering low cost fencing equipment that does not require any modifications to the existing touch-signalling structures and that can also be used by fencers that are not necessarily beginners.

It should be noted that, from the functional viewpoint, the weapon according to the invention, which has been expressly designed for use by beginners, is fully suitable for use in the most advanced fencing categories, with the exception of the material used to make the weapon, which in such cases will not be made from plastic but from metal and will have a specific structure so as to enable the touch-detection unit 10 to be housed in the tip and the touch-signalling unit 15 (complete with mircrochip for processing the signals) to be housed in the grip. The connection between the tip and the grip can, in such cases, be made via one or more external wires, and also using optical fibres.

The weapon 1 described above can advantageously be used in conjunction with a special protective mask which is illustrated diagrammatically in FIGS. 6 to 9. Compared to conventional protective fencing masks having a structure of plastic material, this mask, which is denoted overall by the reference 25, offers the advantage of being lighter and more comfortable, easier to put on, affording greater visibility and being cheaper, while at the same time ensuring the utmost safety.

As is illustrated in the figures, the mask 25 consists of a body 26 made of high strength plastic and provided with perforations, in respect of which only those corresponding to the user's mouth and ears are shown in the drawing. The body 26 is fitted with a flexible bib 27 and with a retaining backstrap 28 and is attached, in a manner such that it can be tilted between a lowered position when in use (shown in the drawings) and a raised position, to a skull cap 29 which fits on the top of the user's head. In order to tilt the body 26 relative to the skull cap 29 two manually operated external side knobs 30 are advantageously provided.

The viewing part of the mask 25, denoted by the reference 31, can consist of a simple perforated metal strip or, more advantageously, of a transparent visor (for example made of high strength plastic) applied over an opening in the front of the body 26.

Figure 11:
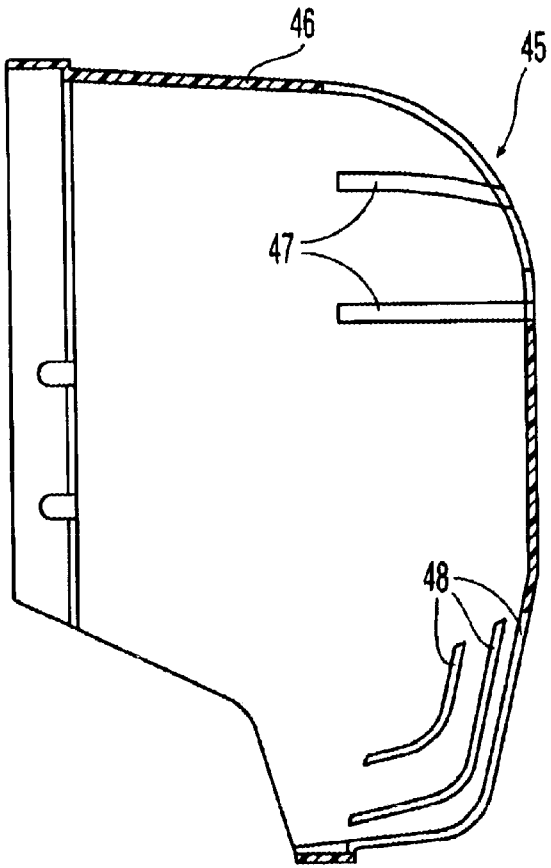
FIG. 11 is a view in vertical section of FIG. 10.
Figure 10:
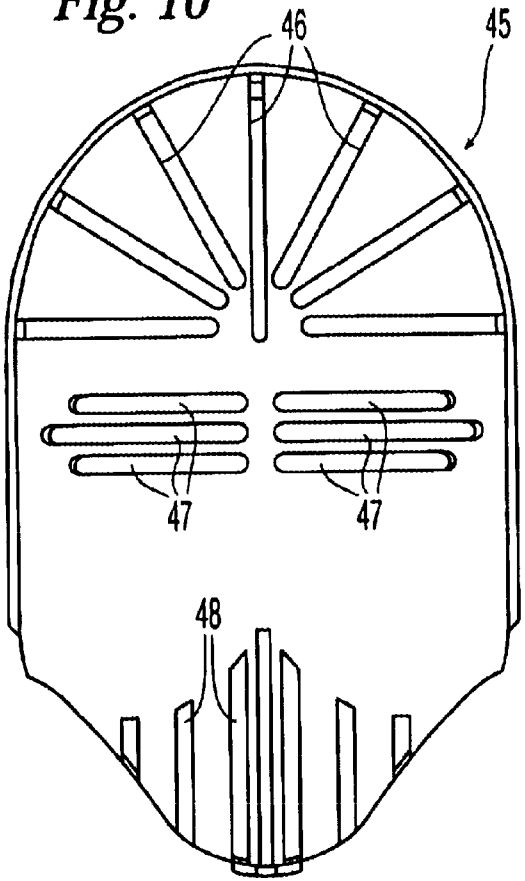
FIG. 10 is a view similar to FIG. 7 showing a variant of the protective mask.

FIGS. 10 and 11 show a variant of the protective mask which is denoted by the reference 45 and likewise consists of a body of high strength plastic. This variant differs from the embodiment described previously essentially in the fact that its perforations are formed by elongate silts 46, 47, 48. In this case also, the perforations 47 of the viewing part of the mask 45 can be replaced by a transparent visor (for example made of high strength plastic) applied over an opening in the front of the body.

The protective mask 25 or 45 can be fitted directly, in a manner not illustrated but within the capabilities of an expert in the field, with the acoustic and/or luminous signalling apparatus which is functionally connected to the signalling unit 15 of the weapon 1. This enables touch signalling to be drastically simplified during fencing practice, thereby facilitating the judges' task.

The combination of the weapon 1 and the protective mask 25 or 45 makes it possible to produce equipment for practising sport fencing in all its forms and without wires and, to sum up, affords the following advantages:

full set of equipment at low cost, high quality, possibility of simulating sport fencing in the most faithful way possible and with respect to the three established disciplines (foil, épée, sabre), no need to use expensive protective clothing, possibility of learning to fence easily, safely and cheaply, more effective teaching, readily promotes sport fencing.

Needless to say, details relating to construction and embodiments can be amply modified relative to those described and illustrated without thereby departing from the scope of the present invention as defined in the following claims.

What is claimed is:

1. A weapon for practising sport fencing comprising a blade having a tip and a grip provided with a guard, said blade and said grip being made from a structure of moulded plastic having a longitudinal through hole which communicates both with a seat formed in said tip and with a receptacle formed inside said grip, said seat having an enlarged configuration which contains a touch-detection unit including a sensor selected from among magnetic sensors, magnetoresistive sensors, Hall sensors, capacitive proximity sensors, photoelectric sensors, pressure sensors, and further comprising a protective button closing off said seat, and said receptacle housing a touch-signalling unit having an associated electrical power supply, said touch-signalling unit being functionally connected to said touch-detection unit.

2. Weapon according to claim 1, wherein said touch-detection unit further includes a push-button type switch associated with the said sensor.

3. Weapon according to claim 1, wherein said touch-signalling unit includes an acoustic warning indicator.

4. Weapon according to claim 1, wherein said guard is made of magnetic, magnetized or metallic material, and is interchangeable with guards made of different materials.

5. Weapon according to claim 1, wherein said touch-signalling unit also includes a remote transmitter whereby the signal indicating a touch can be repeated by a conventional external acoustic/luminous signalling device.

6. Weapon according to claim 2, wherein said protective button is elastically deformable and includes a beaker-shaped body mounted on the said enlarged seat of said tip of the blade and into which said push-button of said switch extends, and a ferrule which is connected to the said beaker-shaped body and can move elastically in an axial direction relative to the latter, between an inactive extended position and a depressed position in which it activates the said push-button of said switch by means of pressure.

7. Weapon according to claim 1, wherein said protective button includes a beaker-shaped body mounted on the said enlarged seat of said tip of the blade and a ferrule which is connected to the said beaker-shaped body and can move elastically in an axial direction relative to the latter, between an inactive extended position and a depressed position in which it directly activates the said touch-signalling unit.

8. Weapon according to claim 7, wherein said beaker-shaped body and said ferrule are made as a single piece of elastic material.

9. Weapon according to claim 8, wherein said elastic material is electrically conductive rubber.

10. Weapon for practising sport fencing comprising a blade having a tip and a grip provided with a guard, and a seat formed in said tip and a receptacle formed inside said grip, said seat having an enlarged configuration which contains a touch-detection unit including a sensor selected from among magnetic sensors, magnetoresistive sensors, Hall sensors, capacitive proximity sensors, photoelectric sensors and pressure sensors, and said receptacle housing therein a touch-signalling unit which is functionally connected to said touch-detection unit.

11. Weapon according to claim 10, wherein said touch-detection unit further includes a push-button type switch associated with said sensor, and further comprising a protective button closing off said seat.

* * * * *